US008444017B2

(12) United States Patent
Chiba et al.

(10) Patent No.: US 8,444,017 B2
(45) Date of Patent: May 21, 2013

(54) PUMP-EQUIPPED CONTAINER AND DUPLEX DISCHARGE CONTAINER

(75) Inventors: Tetsuya Chiba, Sumida-ku (JP); Yoshinori Inagawa, Sumida-ku (JP); Junko Kikkawa, Sumida-ku (JP); Takaharu Tasaki, Koto-Ku (JP)

(73) Assignees: Kao Corporation, Tokyo (JP); Yoshino Kogyosho Co., Ltd., Tokyo (JP)

( * ) Notice: Subject to any disclaimer, the term of this patent is extended or adjusted under 35 U.S.C. 154(b) by 746 days.

(21) Appl. No.: 12/530,525

(22) PCT Filed: Mar. 6, 2008

(86) PCT No.: PCT/JP2008/054036

§ 371 (c)(1),
(2), (4) Date: Jan. 8, 2010

(87) PCT Pub. No.: WO2008/111479

PCT Pub. Date: Sep. 18, 2008

(65) Prior Publication Data

US 2011/0315712 A1 Dec. 29, 2011

(30) Foreign Application Priority Data

| | | |
|---|---|---|
| Mar. 9, 2007 | (JP) | 2007-059656 |
| Jun. 22, 2007 | (JP) | 2007-164926 |
| Jun. 26, 2007 | (JP) | 2007-167546 |
| Nov. 22, 2007 | (JP) | 2007-303524 |

(51) Int. Cl.
*B67D 7/70* (2010.01)

(52) U.S. Cl.
USPC ..... 222/137; 222/135; 222/321.8; 222/321.9; 222/380; 222/385

(58) Field of Classification Search ..... 222/135, 222/137, 321.7–321.9, 372, 380, 383.1, 385
See application file for complete search history.

(56) References Cited

U.S. PATENT DOCUMENTS

| | | | | |
|---|---|---|---|---|
| 4,844,299 | A | 7/1989 | Sekiguchi et al. | |
| 5,769,274 | A * | 6/1998 | Behar | 222/95 |

(Continued)

FOREIGN PATENT DOCUMENTS

| | | |
|---|---|---|
| EP | 0 282 595 A1 | 9/1988 |
| EP | 1 669 139 A1 | 6/2006 |

(Continued)

OTHER PUBLICATIONS

Chinese Office Action issued Feb. 22, 2012, in China Patent Application No. 200880007506.8 (with English Translation).

(Continued)

*Primary Examiner* — J. Casimer Jacyna
(74) *Attorney, Agent, or Firm* — Oblon, Spivak, McClelland, Maier & Neustadt, L.L.P.

(57) ABSTRACT

A pump-equipped container (10) includes a tubular container body (11) that is made of a sheet material having flexibility and a pump device (13) that includes a pump body (15) and a nozzle portion (14). A one-end section of the container body is closed off, and the pump device (13) is attached to the other-end section of the container body. The pump body (15) has an outer-circumferential-surface section (16) that comes into close contact with an inner circumferential surface of the other-end section (11*b*) of the container body (11). The pump device (13) is attached to the other-end section (11*b*) of the container body (11) in such a state that the outer-circumferential-surface section (16) is covered with the container body (11) by being brought into close contact with the inner circumferential surface of the other-end section (11*b*) of the container body (11). The container body (11) is formed using a sheet material having a gas barrier property.

20 Claims, 10 Drawing Sheets

U.S. PATENT DOCUMENTS

| | | | | |
|---|---|---|---|---|
| 6,341,717 | B2 | 1/2002 | Auer | |
| 6,622,890 | B2 * | 9/2003 | Gueret | 222/1 |
| 7,481,334 | B2 * | 1/2009 | Arghyris et al. | 222/137 |
| 2001/0011562 | A1 | 8/2001 | Bailly | |
| 2006/0163282 | A1 | 7/2006 | Suzuki | |
| 2007/0012723 | A1 * | 1/2007 | Laidler et al. | 222/135 |

FOREIGN PATENT DOCUMENTS

| | | | |
|---|---|---|---|
| JP | 63 99868 | | 6/1988 |
| JP | 3-11680 | U | 2/1991 |
| JP | 8-11905 | | 1/1996 |
| JP | 09-501352 | A | 2/1997 |
| JP | 11-76883 | A | 3/1999 |
| JP | 2000 117162 | | 4/2000 |
| JP | 2000-297018 | | 10/2000 |
| JP | 2001-63782 | A | 3/2001 |
| JP | 2001-97468 | A | 4/2001 |
| JP | 2002-2757 | | 1/2002 |
| JP | 2002-59981 | A | 2/2002 |
| JP | 2002-119328 | | 4/2002 |
| JP | 2002-369712 | A | 12/2002 |
| JP | 2003 190849 | | 7/2003 |
| JP | 2004-160416 | A | 6/2004 |
| JP | 2005 126144 | | 5/2005 |
| JP | 2006 69581 | | 3/2006 |
| JP | 2006-306478 | | 11/2006 |

OTHER PUBLICATIONS

Office Action issued on May 30, 2011 in the corresponding Chinese Patent Application No. 200880007506.8 (with English Translation).

Office Action issued Aug. 21, 2012 in Japanese Patent Application No. 2008-161164 with English language translation.

Office Action issued Jun. 26, 2012 in Japanese patent Application No. 2008-058408 with English language translation.

Rejection issued Jun. 26, 2012 in Chinese Patent Application No. 200880007506.8 (with English translation).

* cited by examiner

PUMP-EQUIPPED CONTAINER AND DUPLEX DISCHARGE CONTAINER

TECHNICAL FIELD

The present invention relates to a pump-equipped container having a pump device attached to an end of a container body.

The present invention also relates to a duplex discharge container having two juxtaposed pump-equipped containers.

BACKGROUND ART

A tube container, which is an example of a tubular container using a sheet material having flexibility, is generally formed by joining a bottom plate to a one-end section of its cylindrical tube to close off the one-end section or by squashing and sealing the one-end section in a flattened state to close it off, as well as by integrally joining a mouth component having a shoulder portion and a mouth-neck portion to the other-end section. The body portion contains, for example, a highly-viscous liquid-form substance as its contents, and the container is used by pressing and deforming the body portion to discharge the contents from the mouth-neck portion. The outer circumferential surface of the mouth-neck portion has, for example, an external thread, and a cap is detachably screwed onto the mouth component through the external thread, allowing the mouth-neck portion to be opened and closed. Further, for example, the cylindrical tube and the mouth component of the tube container are formed using, for example, aluminum or an aluminum-laminated resin having an oxygen barrier property. In this way, the oxygen barrier function prevents deterioration of the contained contents over a long period of time.

Meanwhile, various types of tube containers have been developed depending, for example, on the type of contents and/or their use. For example, a tube container has been disclosed in which the contents are discharged not by pressing of the body portion, but by use of a pump device attached to the mouth-neck portion, which sucks the contents and discharges the same through a nozzle portion of the pump device (see, for example, JP-A-8-11905). Such a tube container utilizes, for example, the mouth-neck portion having the external thread for attaching and fixing the pump device to the mouth component of the tube container via a connection component having an internal thread.

A high oxygen barrier property has been heretofore required of containers for contents that are deteriorated by oxygen, and for example, aluminum tube containers are widely used for containers containing hair-dyeing agents.

Meanwhile, various types of pump-equipped containers having a pump device fixed to the mouth portion of the container body have been proposed for improving container usability. For example, JP-A-8-11905 mentioned above discloses a pump-equipped tube container that uses a pump device fixed to the mouth portion of the container body to suck up the contents put in the container body and discharge the same from a nozzle portion of the pump device.

With products that use two types of agents (a first agent and a second agent), such as two-agent-type hair dyes, which are mixed immediately before use, the first and second agents are filled respectively into separate containers. Heretofore, the contents (the product) have been discharged separately from their respective containers at prescribed rates and mixed upon use, thus complicating the procedure.

On the other hand, there is known a duplex discharge container capable of discharging, with a single operation, the first and second agents respectively from two juxtaposed containers (see, for example, JP-A-2002-119328 and JP-A-2006-306478).

DISCLOSURE OF THE INVENTION

A pump-equipped container of the present invention includes a tubular container body that is made of a sheet material having flexibility and a pump device that includes a pump body and a nozzle portion. A one-end section of the container body is closed off, and the pump device is attached to the other-end section of the container body. The pump body has an outer-circumferential-surface section that comes into close contact with an inner circumferential surface of the other-end section of the container body. The pump device is attached to the other-end section of the container body in such a state that the outer-circumferential-surface section is covered with the container body by being brought into close contact with the above-mentioned inner circumferential surface.

In a duplex discharge container of the present invention, two of the pump-equipped containers are juxtaposed to one another. Each of the two pump-equipped containers includes a tubular container body that is made of a sheet material having flexibility and whose one-end section is closed off, and a pump device that is attached to a mouth portion of the container body and that includes a pump body and a nozzle portion. The pump body has an outer-circumferential-surface section that comes into close contact with an inner circumferential surface of the mouth portion of the container body, and is fixed to the mouth portion of the container body in such a state that the outer-circumferential-surface section is covered with the container body by being brought into close contact with the above-mentioned inner circumferential surface. The duplex discharge container includes a holder for holding the two pump-equipped containers in a juxtaposed state, and pumping means configured to perform pumping action of the pump device.

BRIEF DESCRIPTION OF THE DRAWINGS

FIG. 4(*b*) is a partially-enlarged vertical cross-sectional view (a view corresponding to FIG. 2) with the discharge valve opened.

FIG. 6(*b*) is a partially-enlarged vertical cross-sectional view (a view corresponding to FIG. 2) showing a third modified example of a form of fixing the pump device and the container body.

FIG. 7(*b*) is a partially-enlarged vertical cross-sectional view (a view corresponding to FIG. 2) showing a fifth modified example of a form of fixing the pump device and the container body.

DETAILED DESCRIPTION OF THE INVENTION

Figure 1:
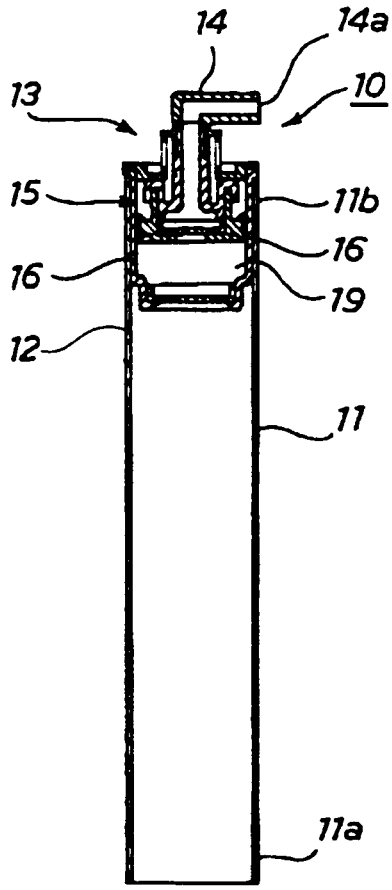
FIG. 1 is a vertical cross-sectional view showing a pump-equipped container according to a first embodiment of the present invention.

In a heretofore tube container equipped with a pump device, the pump device is attached to a mouth-neck portion of a mouth component which is provided projecting from the end of a cylindrical tube, with a connection component interposed therebetween. Such a structure increases the size of the section projecting from the cylindrical tube, which makes it difficult to achieve downsizing of the container and tends to lead to an out-of-balance design.

Further, a pump device is usually formed using a material that has a poor oxygen barrier property, such as a polyolefin resin. Therefore, in cases where contents prone to deteriorate through oxidization are contained in a tubular container made using a flexible sheet material, it is necessary to prevent deterioration of the contents due to an inflow of oxygen via the pump device—especially prior to use of the tubular container, such as during distribution thereof.

In cases where contents that deteriorate through oxidization (such as hair-dyeing agents) are put in such a pump-equipped tube container, it is necessary to provide the entire container, including the pump device, with an oxygen barrier property. However, as described above, a pump device is generally formed using, for example, a polyolefin resin that has a poor oxygen barrier property. Therefore, there is a problem (problem #1) in that it is necessary to provide some kind of a contrivance such as forming a portion of the pump device with a component having an oxygen barrier property, which may lead to an increase in cost.

In view of such circumstances, it is also possible to consider providing an oxygen barrier property only to the tube container and attaching a pump device to such a tube container upon use. However, other problems (problem #2) may arise in that attaching a pump device upon use is troublesome, and further in that separately forming the tube container and the pump device makes it necessary to provide a separate receptacle, such as a box, for storing the tube container before use and also increases the overall size of the product (the pump-equipped container).

The above-described problems arise also in cases where it is necessary to provide a gas barrier property, other than an oxygen barrier property, to the pump device, and also arise in containers other than tube containers and in pump devices that are separable from the container body.

Meanwhile, as an example of a duplex discharge container capable of discharging, with a single operation, first and second agents respectively from two juxtaposed containers, there is known a duplex discharge container having two juxtaposed aerosol containers and being provided with an operation component that allows the stems to be pushed down with a single operation (see, for example, JP-A-2000-297018).

However, because the containers are of the aerosol type, such a duplex discharge container having the two juxtaposed aerosol containers involves such problems as being expensive in terms of manufacturing cost, being troublesome as it requires degassing upon disposal, and causing difficulty in discharging a prescribed amount of contents.

There is also known a duplex discharge container in which a casing component accommodating two juxtaposed container bodies is detachably attached to a base component having two pumps (see, for example, JP-A-2002-2757).

However, the duplex discharge container disclosed in JP-A-2002-2757 involves a vast number of components, which leads to increased costs and also requires time and effort in assembling the components.

As regards a duplex discharge container having two juxtaposed aerosol containers such as the one disclosed in JP-A-2002-119328, placing highly-viscous contents inside the aerosol containers tends to cause discharging problems and thus causes handling difficulties. Therefore, such a duplex discharge container has been primarily used as a discharge container for contents having low viscosity.

On the other hand, pump-equipped containers have been widely used as discharge containers for containing highly-viscous contents. The duplex discharge container having two juxtaposed pump-equipped containers disclosed for example in JP-A-2006-306478 is often intended for highly-viscous contents, because the pump-equipped containers are suitable as discharge containers for discharging highly-viscous contents.

Meanwhile, in cases where the duplex discharge container contains e.g., a two-agent-type hair dye—the first agent being a hair-dyeing component and the second agent being an oxidizing agent—there are instances in which the first and second agents are not discharged at an appropriate timing.

More specifically, heretofore hair-dyeing agents have been designed on the assumption that the two agents are to be discharged simultaneously, but since the second agent generally has a lower viscosity than the first agent, the second agent will be discharged ahead of the first agent if a heretofore duplex discharge container is used as is. However, depending on the product design, it is preferable to discharge the first agent ahead of the second agent so that reactions occur after the first agent has permeated into the hair.

The present invention relates to a pump-equipped tube container that allows the entire container to be downsized easily. The present invention also relates to a pump-equipped tube container that can effectively avoid deterioration of contents prior to use, such as during distribution, even when containing contents prone to deteriorate through oxidization.

Furthermore, the present invention relates to a pump-equipped container capable of achieving, at low cost, a gas barrier property in a pump device without forming the pump device using components having a gas barrier property.

Moreover, the present invention relates to a duplex discharge container having two pump-equipped containers juxtaposed to one another, wherein the number of components of the container is small, the cost of components can be reduced, and the time and effort for assembling the components can also be saved.

Further, the present invention relates to a duplex discharge container that includes two juxtaposed pump-equipped containers each having a pump device including a pump body and a nozzle portion, wherein the two agents respectively contained in the two pump-equipped containers can be discharged at a timing according to the product design.

A pump-equipped container of the present invention includes a tubular container body that is made of a sheet material having flexibility and a pump device that includes a pump body and a nozzle portion. A one-end section of the container body is closed off, and the pump device is attached to the other-end section of the container body. The pump body has an outer-circumferential-surface section that comes into close contact with an inner circumferential surface of the other-end section of the container body. The pump device is attached to the other-end section of the container body in such a state that the outer-circumferential-surface section is covered with the container body by being brought into close contact with the above-mentioned inner circumferential surface.

In the pump-equipped container of the present invention, it is preferable that the container body is formed using a sheet material having a gas barrier property.

In the pump-equipped container of the present invention, it is preferable that an inert gas that is chemically inert to contents of the container body is filled inside a measuring chamber of the pump body.

In the pump-equipped container of the present invention, it is preferable that a discharge valve of a pump mechanism provided inside the pump body is a valve that does not open by pressurization of the measuring chamber but opens mechanically by pressing of the nozzle.

Further, in a duplex discharge container of the present invention, two of the pump-equipped containers are juxtaposed to one another. Each of the two pump-equipped containers includes a tubular container body that is made of a sheet material having flexibility and whose one-end section is closed off, and a pump device that is attached to a mouth portion of the container body and that includes a pump body and a nozzle portion. The pump body has an outer-circumferential-surface section that comes into close contact with an inner circumferential surface of the mouth portion of the container body, and is fixed to the mouth portion of the container body in such a state that the outer-circumferential-surface section is covered with the container body by being brought into close contact with the above-mentioned inner circumferential surface. The duplex discharge container includes a holder for holding the two pump-equipped containers in a juxtaposed state, and pumping means configured to perform pumping action of the pump device.

In the duplex discharge container of the present invention, it is preferable that the nozzle portion of each of the two juxtaposed pump-equipped containers is arranged such that a discharge opening of each nozzle portion is located adjacent to one another, and the pumping means is configured to perform pumping action of the pump device of both the two juxtaposed pump-equipped containers with a single operation. Further, it is preferable that the duplex discharge container is configured such that, when contents are placed inside the container body of each of the two pump-equipped containers and the pumping means is used to perform the pumping action, the contents in one of the pump-equipped containers are discharged from the nozzle portion before the contents of the other pump-equipped container.

A pump-equipped container of the present invention is described below according to a first embodiment, which is one preferred embodiment, with reference to the drawings.

Figure 2:
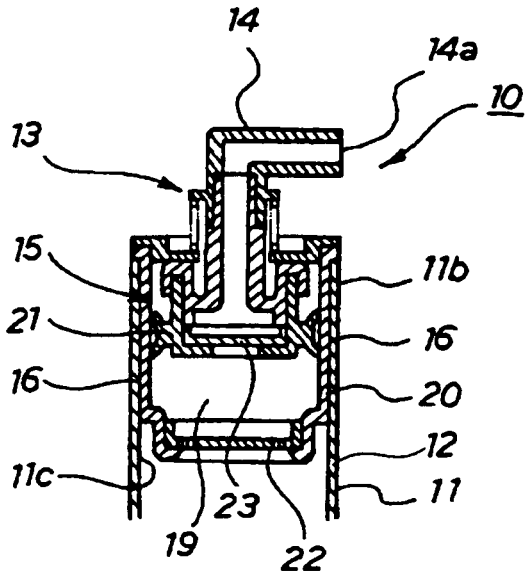
FIG. 2 is a partially enlarged view of the pump-equipped container shown in FIG. 1.

As illustrated in FIGS. 1 and 2, a pump-equipped container 10 of the first embodiment is a pump-equipped container having a compact form, in which a pump device 13 is fixed to a mouth portion 11*b* provided in the "other-end section" of a container body 11 having a gas barrier property.

The pump device 13 has a pump body 15 including a measuring chamber 19, and a nozzle portion 14.

The container body 11 is a tubular body that is made of a sheet material having flexibility and whose one-end section (also referred to as "lower-end section") 11*a* on the opposite side from the mouth portion (the other-end section) 11*b* is closed off.

The container body 11 contains contents that deteriorate through oxidization (not shown).

An example of such contents includes a first agent of a two-agent-type hair dye, which is a highly-viscous liquid-form substance. The container body 11 of the present embodiment contains the first agent of the two-agent-type hair dye. The contents put in the container body 11 are sucked up by the pumping effect of the pump device 13 and discharged from the nozzle portion 14.

The pump body 15 has an outer-circumferential-surface section 16 that comes into close contact with an inner circumferential surface 11*c* of the mouth portion 11*b* of the container body 11, and is fixed to the mouth portion 11*b* in such a state that the outer-circumferential-surface section 16 is covered with the container body 11 by being brought into close contact with the inner circumferential surface 11*c*.

In order to prevent deterioration of contents that are deteriorated by oxygen in cases where such contents are placed inside the container body 11, the container body 11 is made of a sheet material having an oxygen barrier property. An example of such a sheet material includes an aluminum-laminated resin. The container body 11 is formed into a cylindrical shape having, for example, an inner diameter of around 10 to 50 mm and a height (length) of around 70 to 200 mm.

For example, the lower-end section 11*a* of the container body 11 is closed off as follows. First, the pump device 13 is fixed to the mouth portion 11*b*. Contents are filled into and placed inside the container body 11 from the lower-end section 11*a* according to ordinary methods for forming a pump-equipped tube container. Then, the lower-end section 11*a* is squashed into a flat state, and in doing so, the innermost sealant layer of the aluminum-laminated resin sheet is heat-sealed using known heat-sealing means. Note that FIG. 1 shows a state before the lower-end section 11*a* is closed off by heat-sealing.

The pump device 13 fixed to the mouth portion 11*b* of the container body 11 is generally made of a synthetic resin such as a polyolefin resin, and as described above, is constituted of the pump body 15 and the nozzle portion 14. The pump body 15 has, in its interior, a known pump mechanism including a measuring chamber 19. More specifically, the pump body 15 includes, for example, a tubular cylinder 20, a piston 21 that is in close contact with and slides along the inner surface of the cylinder 20, a suction valve 22 provided at the lower end of the cylinder 20, and a discharge valve 23 provided at the lower end of the piston 21.

The outer envelope of the pump body 15 is structured by the outer-circumferential-surface section 16 which has a cylindrical sleeve-like shape. The outer diameter of the outer-circumferential-surface section 16 is equal to or slightly larger than the inner diameter of the container body 11. Accordingly, the outer circumferential surface of the outer-circumferential-surface section 16 comes firmly into close contact with the inner circumferential surface 11*c* of the mouth portion 11*b* when the pump body 15 is inserted into and attached to the mouth portion 11*b* of the container body 11.

The outer circumferential surface of the outer-circumferential-surface section 16 of the pump body 15 is made, for example, of a polyolefin resin having heat-sealability. After attachment of the pump body 15 to the mouth portion 11*b* of the container body 11, applying heat-sealing from outside the container body 11 using a known heat-sealing means will allow the outer circumferential surface of the outer-circumferential-surface section 16 of the pump body 15 and the inner circumferential surface 11*c* of the mouth portion 11*b* of the container body 11 to be firmly joined in close contact with one another in a gas-tight state.

The nozzle portion 14 is connected to the piston 21 and is provided projecting upward from the pump body 15. With this pump device 13, repeatedly pressing the nozzle portion 14, for example, will cause the piston 21 to slide in close contact along the cylinder 20, and the pumping effect caused thereby will allow the contents to be sucked from the container body 11 into the measuring chamber 19 through the suction valve 22. Then, a necessary amount of the contents sucked into the measuring chamber 19 can be discharged from a nozzle opening 14*a* provided in the tip end of the nozzle portion 14 through the discharge valve 23.

As described above, the pump device 13 is made of a synthetic resin such as a polyolefin resin, and the pump device 13 formed of such a material does not have an oxygen barrier property per se. Therefore, in the pump device 13 of the present embodiment, an inert gas that is inert to the contents of the container body 11 is filled inside the measuring chamber 19. The term "inert" is used herein in a relative sense with respect to the contents. Specifically, nitrogen gas or helium gas may be given as examples of an inert gas that is inert to contents that are deteriorated by oxygen, such as the hair-dyeing agent in the present embodiment.

According to the pump-equipped container of the first embodiment structured as above, the entire pump-equipped container 10 can be downsized easily. More specifically, the pump body 15 has an outer-circumferential-surface section 16 that comes into close contact with an inner circumferential surface 11*c* of the mouth portion 11*b* of the container body 11, and the pump device 13 is attached to the mouth portion 11*b* of the container body 11 in such a state that the outer-circumferential-surface section 16 is covered with the container body 11 by being brought into close contact with the inner circumferential surface 11*c* of the mouth portion 11*b* of the container body 11. This allows substantially only the nozzle portion 14 of the pump device 13 to project from the mouth portion 11*b* of the container body 11. Accordingly, it is possible to easily downsize the entire pump-equipped container 10 and also achieve a well-balanced design.

Further, in addition to being able to easily downsize the entire container, the present first embodiment can effectively avoid deterioration of contents prior to use, such as during distribution, even when contents prone to deteriorate through oxidization, such as hair dye, are contained. More specifically, in the present first embodiment, the container body 11 is formed using a sheet material having flexibility as well as an oxygen barrier property, and bringing the outer circumferential surface of the outer-circumferential-surface section 16 of the pump body 15 into close contact with the inner circumferential surface of the other-end section of the container body 11 allows the outer-circumferential-surface section 16 to be covered with the container body 11 thus having an oxygen barrier property. Further, interposition of the pump body 15 secures a considerable distance between the opened end of the mouth portion (the other-end section) 11*b* of the container body 11 and a containment body portion 12 in which the contents are placed. Accordingly, it becomes possible to effectively avoid deterioration of hair-dyeing agents, serving as the contents, during distribution etc.

The pump-equipped container 10 of the first embodiment also achieves the following effects:

An inert gas that is inert to the contents (hair-dyeing agent) of the container body 11 is filled inside the measuring chamber 19 of the pump device 13. Thus, it is possible to achieve, at low cost, a gas barrier property in the pump device 13 without forming the pump device 13 using components having a gas barrier property (oxygen barrier property).

Note that depending on the type of contents, either forming the container body 11 using a sheet material having a gas barrier property, or filling an inert gas that is inert to the contents of the container body 11 inside the measuring chamber 19 of the pump body 15, may suffice in some cases.

Next, other embodiments of the pump-equipped container according to the present invention are described. The following mainly describes features of the other embodiments that are different from the foregoing first embodiment, and features in common are accompanied with the same symbols and are omitted from explanation. The explanation given in the first embodiment applies as appropriate to features that are not particularly explained below. The other embodiments also achieve the same effects as those of the first embodiment.

In a pump-equipped container 10 of a second embodiment, the pump device 13 is further improved in gas barrier property by using a component having a gas barrier property in some parts of the pump device 13.

Figure 3:
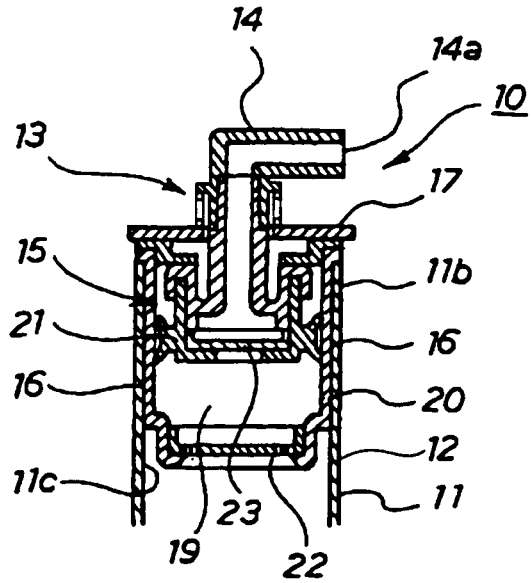
FIG. 3 is a partially-enlarged vertical cross-sectional view (a view corresponding to FIG. 2) showing a pump-equipped container according to a second embodiment of the present invention.

This is described in detail. As illustrated in FIG. 3, in the pump-equipped container 10 of the second embodiment, a barrier member 17 is mounted covering an upper end surface of the pump body 15 of the pump device 13. The barrier member 17 is made, for example, of a resin having a good oxygen barrier property, such as an aluminum-laminated resin, polyethylene naphthalate resin (PEN), or ethylene/vinyl alcohol copolymer resin (EVOH).

In the second embodiment, the barrier member 17 is mounted covering the upper end surface of the pump body 15, i.e., covering the upper areas of the inner-diameter cross-sectional portion and the outer wall of the measuring chamber 19. This further improves the gas barrier property of the pump device 13.

More specifically, in the present second embodiment, it is possible to mount a barrier member 17—which is made of a resin having a good oxygen barrier property, such as an aluminum-laminated resin, polyethylene naphthalate resin (PEN), or ethylene/vinyl alcohol copolymer resin (EVOH)—preferably covering the upper end surface of the pump body 15 of the pump device 13 attached to the mouth portion 11*b* of the container body 11. Mounting a barrier member 17 to cover the upper end surface of the pump body 15 will provide an oxygen barrier layer created by the barrier member 17 which covers the opened end of the mouth portion 11*b* of the container body 11, thus allowing deterioration of the hair-dyeing agent, serving as the contents, during distribution etc. to be avoided more effectively. Note that one conceivable way of providing an oxygen barrier layer on the opened end of the mouth portion 11*b* of the container body 11 may be to form the entire pump device 13 or the entire pump body 15 with a resin having a good oxygen barrier property. However, such a resin is usually expensive. Therefore, mounting the barrier member 17 on the upper end surface of the pump body 15, as in the present second embodiment, will allow a reduction in costs.

Figure 4A:
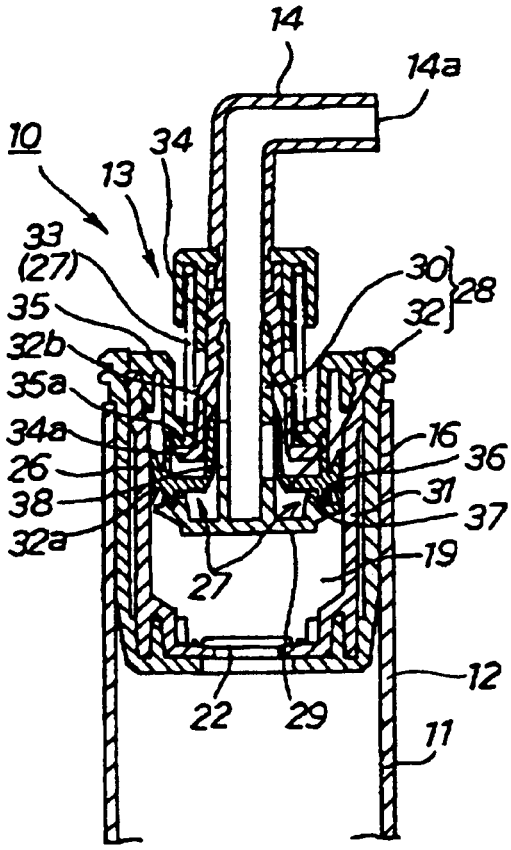
FIG. 4(*a*) is a partially-enlarged vertical cross-sectional view (a view corresponding to FIG. 2) showing a pump-equipped container according to a third embodiment of the present invention, with its discharge valve closed.
Figure 4B:
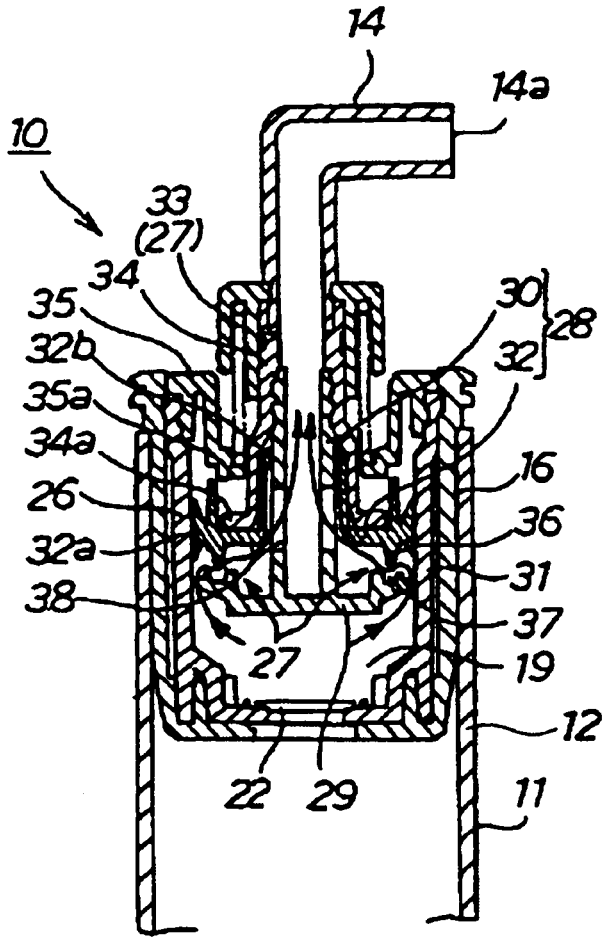

As illustrated in FIGS. 4(*a*) and 4(*b*), in a pump-equipped container 10 of a third embodiment, a discharge valve 27 that constitutes the pump mechanism provided inside a pump body 26 is a mechanically opening/closing valve that is opened and closed mechanically, not through change in internal pressure of the measuring chamber 19. In other words, the discharge valve 27 is a valve that does not open by pressurization of the measuring chamber 19 but opens mechanically by pressing of the nozzle portion 14.

This is described in detail. In the pump-equipped container 10 of the third embodiment, a piston 28 of the pump body 26 has a piston attachment tube 30 having a projecting bottom portion 29 at its lower end, and a hat-shaped sliding tube 32 having a projecting sliding-contact portion 32*a* that slides in close contact along the inner circumferential surface of a cylinder 31 and an inner-circumference sliding-contact portion 32*b* that slides in close contact along the outer circumferential surface of the piston attachment tube 30.

Before the nozzle portion 14 is pressed, a projecting engagement flange 34*a* of an inner pressing tube 34 that is integrally connected to the upper portion of the piston attachment tube 30 abuts against and engages with a lower-end engagement portion 35*a* of a top surface plate 35 of the pump body 26 due to an urging force exerted by a spring member 33. In this state, an annular projection rib 36 that projects downward from the lower surface of the projecting portion of the sliding tube 32 is fitted into and is in close contact with an annular depression groove 37 provided in the circumferential edge of the upper surface of the projecting bottom portion 29 of the piston attachment tube 30. This blocks circulation of contents between these components (see FIG. 4(*a*)).

When the nozzle portion 14 is pressed against the urging force of the spring member 33 to thereby press down the inner pressing tube 34 and the piston attachment tube 30 along with the nozzle portion 14, the projecting engagement flange 34*a* of the inner pressing tube 34 first moves downward from its current state of abutment against the lower-end engagement portion 35*a* of the top surface plate 35 of the pump body 26 until it abuts against the upper surface of the projecting portion of the sliding tube 32 (see FIG. 4(*b*)). Accordingly, the piston attachment tube 30 moves downward relative to the sliding tube 32. This disengages the annular projection rib 36 of the sliding tube 32 from the annular depression groove 37 of the projecting bottom portion 29 of the piston attachment tube 30, thus forming a clearance therebetween for allowing circulation of the contents. As described above, pressing of the nozzle portion 14 causes the piston attachment tube 30, which is substantially integral with the nozzle portion 14, to move, thus releasing the seal between the valving element (annular projection rib 36) and the valve seat (annular depression groove 37) and causing the valve to open.

In other words, the spring member 33, the annular projection rib 36 of the sliding tube 32, and the annular depression groove 37 of the projecting bottom portion 29 of the piston attachment tube 30 constitute the discharge valve 27 that is opened and closed mechanically, not by change in internal pressure of the measuring chamber 19.

Pressing down the inner pressing tube 34 and the piston attachment tube 30 even further will cause the projecting bottom portion 29 of the piston attachment tube 30 to move downward along with the sliding tube 32, thereby pressurizing the measuring chamber 19 (see FIG. 4(*b*)). This will cause the contents inside the measuring chamber 19 to be pushed upward through a clearance between the outer circumferential surface of the projecting bottom portion 29 of the piston attachment tube 30 and the inner circumferential surface of the cylinder 31 as well as through a clearance between the annular projection rib 36 of the sliding tube 32 and the annular depression groove 37 in the projecting bottom portion 29 of the piston attachment tube 30. The contents having been pushed first flow into the hollow interior of the piston attachment tube 30 through a discharge valve opening 38 formed in the piston attachment tube 30, and then pass through the nozzle portion 14, and are discharged from the nozzle opening 14*a* at the tip end.

Then, releasing the pressing of the nozzle portion 14 will first cause the nozzle portion 14 as well as the piston attachment tube 30 to move upward relative to the sliding tube 32, which causes the annular projection rib 36 of the sliding tube 32 to fit into close contact with the annular depression groove 37 in the projecting bottom portion 29 of the piston attachment tube 30, thus closing off the discharge valve 27. Then, the piston attachment tube 30 and the sliding tube 32 rise together until the projecting engagement flange 34*a* of the inner pressing tube 34 abuts against the lower-end engagement portion 35*a* of the top surface plate 35 of the pump body 26, returning to the initial state shown in FIG. 4(*a*). In association therewith, the interior of the measuring chamber 19 assumes a negative pressure, and so the suction valve 22 opens up and the contents in the container body 11 flow into the measuring chamber 19.

According to the pump-equipped container 10 of the third embodiment, the discharge valve 27 is a mechanically opening/closing valve that is opened and closed mechanically, not by change in internal pressure of the measuring chamber 19. Accordingly, even in cases where, for example, a change in surrounding environmental temperatures causes the inert gas filled inside the measuring chamber 19 to expand during the period from when the pump-equipped container 10 is manufactured until it is used, there is no possibility that an increase in internal pressure of the measuring chamber 19 due to the expansion of the inert gas filled inside the measuring chamber 19 will cause the discharge valve 27 to open. Thus, it becomes possible to effectively avoid leakage of the inert gas enclosed inside the measuring chamber 19 during the period from when the pump-equipped container 10 is manufactured until it is used, thereby to further improve the gas barrier property of the pump device 13 and the pump-equipped container 10.

Note that the pump-equipped container of the present invention is not limited to the foregoing embodiments and may be modified in various ways. For example, in cases where contents that do not deteriorate through oxidization are to be contained, the container body does not necessarily have to be made using a sheet material having an oxygen barrier property. Further, other than heat-sealing, means employing hot-melting may be adopted as the means for joining the inner circumferential surface of the other-end section of the container body and the outer-circumferential-surface section of the pump body into close contact with one another. Furthermore, other than hair-dyeing agents, the contents to be contained may be various other types of liquid-form contents having flowability.

The pump device 13 of the foregoing embodiments is fixed to the mouth portion 11*b* of the container body 11, which has a gas barrier property, to constitute the pump-equipped container 10. The pump device, however, may be structured as an attachable/detachable pump device (not shown) that is attachable to and detachable from the mouth portion 11*b* of the container body 11. A pump device having such a structure can achieve the same functions as those of the pump-equipped container 10 of the foregoing embodiments by being fixed to a container body 11 into which contents have been placed.

In the foregoing embodiments, since a hair-dyeing agent that is deteriorated by oxygen is employed as the contents, the container body 11 is formed using a material having an oxygen barrier property and an inert gas that is inert to the hair-dyeing agent is filled inside the measuring chamber 19 of the pump device 13. In the present invention, however, it is possible to change, as appropriate, the material for forming the container body 11 and the inert gas to be filled inside the measuring chamber 19 depending on the contents. For example, in cases where a liquid containing sodium hydroxide that is deteriorated by carbon dioxide is to be placed inside the container body 11, the container body 11 may be formed using a material having a carbon-dioxide barrier property and an inert gas that is inert to sodium hydroxide may be filled inside the measuring chamber 19.

Figure 5:
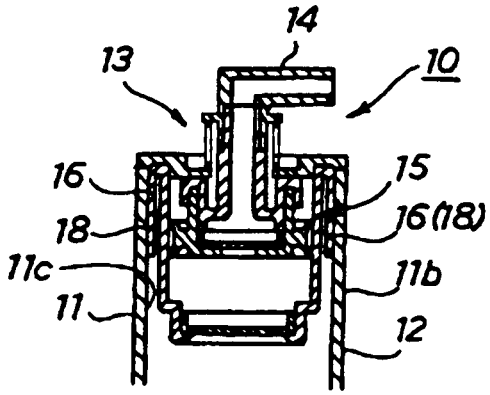
FIG. 5 is a partially-enlarged vertical cross-sectional view (a view corresponding to FIG. 2) showing a first modified example of a form of fixing a pump device and a container body.

Further, as illustrated in FIG. 5, a skirt wall 18 may be provided on the outside of the outer envelope of the pump body 15, thus forming a double-wall structure, and the skirt wall 18 may form the outer-circumferential-surface section 16. Adopting a double-wall structure is advantageous in that no excessive load is applied to the pump body 15 upon heat-sealing of the container body 11 and the pump body 15.

Figure 6A:
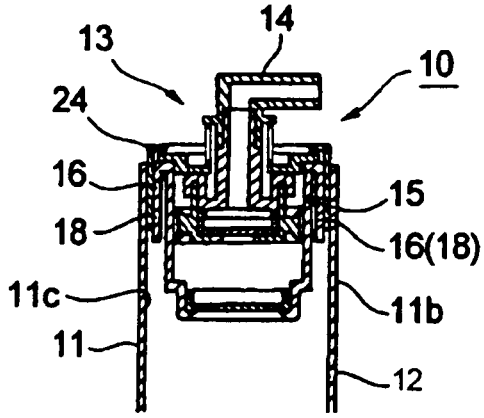
FIG. 6(*a*) is a partially-enlarged vertical cross-sectional view (a view corresponding to FIG. 2) showing a second modified example of a form of fixing the pump device and the container body.
Figure 6B:
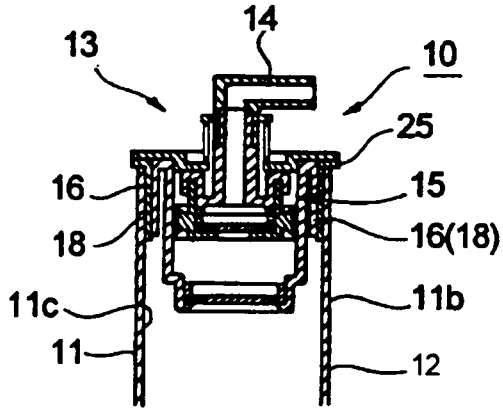

Between the outer-circumferential-surface section 16 (skirt wall 18) of the pump body 15 of the pump device 13 and the inner circumferential surface 11*c* of the mouth portion 11*b* of the container body 11, it is possible to provide flanged heat-sealing 24 that covers the outer-circumferential-surface section 16 and the upper end of the pump body 15 as illustrated in FIG. 6(*a*), or flanged heat-sealing 25 that covers the outer-circumferential-surface section 16 of the pump body 15 as illustrated in FIG. 6(*b*).

Figure 7A:
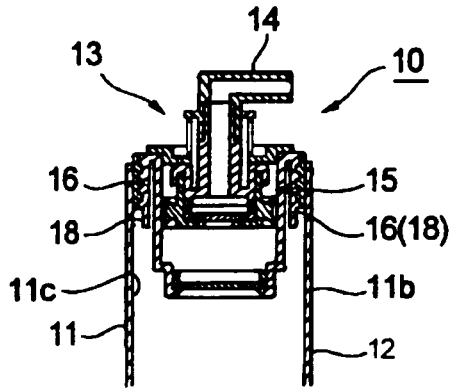
FIG. 7(*a*) is a partially-enlarged vertical cross-sectional view (a view corresponding to FIG. 2) showing a fourth modified example of a form of fixing the pump device and the container body.
Figure 7B:
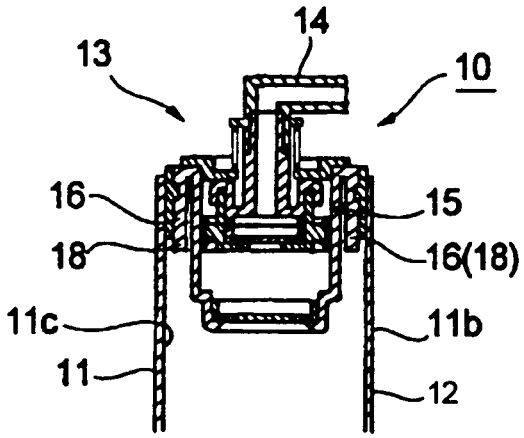

The outer-circumferential-surface section 16 (skirt wall 18) of the pump body 15 of the pump device 13 and the inner circumferential surface 11*c* of the mouth portion 11*b* of the container body 11 may be fixed together in a close-contact state by fitting and attaching them together with screws as illustrated in FIG. 7(*a*), or they may be fixed together in a close-contact state by fitting and attaching them together through drive-fitting as illustrated in FIG. 7(*b*).

Below, a duplex discharge container of the present invention is described according to a fourth embodiment, which is one preferred embodiment, with reference to the drawings.

Figure 8:
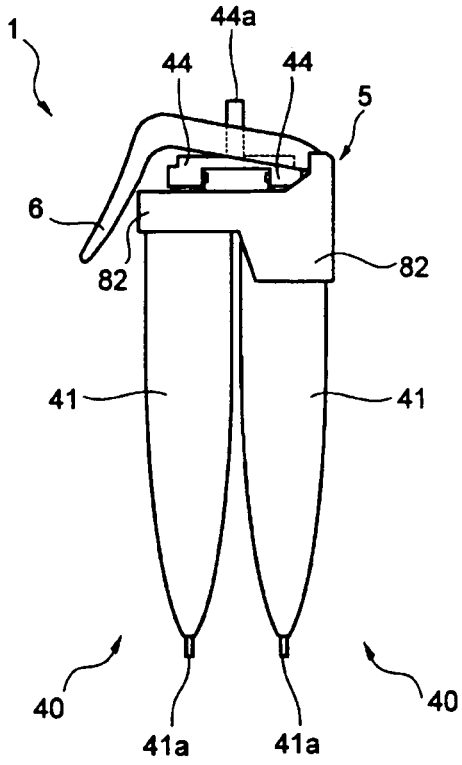
FIG. 8 is a front view showing a duplex discharge container according to a fourth embodiment of the present invention.
Figure 9:
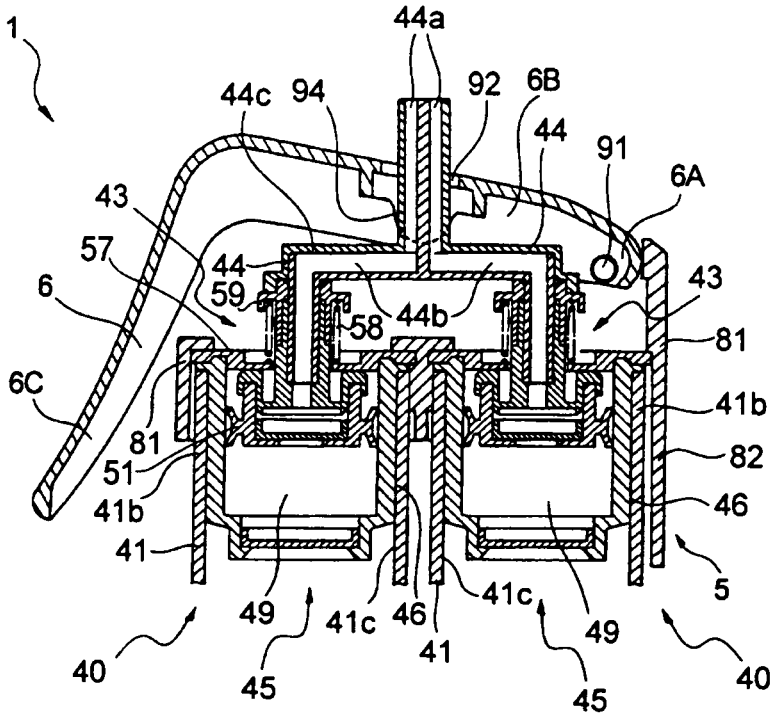
FIG. 9 is a partially-enlarged cross-sectional view of an upper portion of the duplex discharge container of the fourth embodiment.
Figure 10:
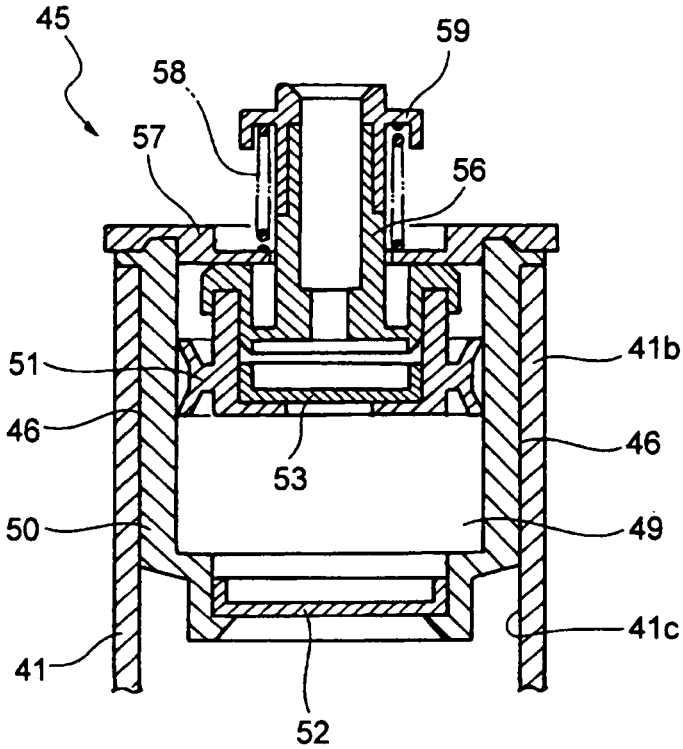
FIG. 10 is a partially-enlarged cross-sectional view of a pump body etc. of the duplex discharge container of the fourth embodiment.

As illustrated in FIGS. 8 to 10, the duplex discharge container 1 according to the fourth embodiment is a duplex discharge container having two juxtaposed pump-equipped containers 40, 40 each having a container body 41 and a pump device 43. The container body 41 is a tubular body that is made of a sheet material having flexibility and whose one-end section 41*a* is closed off. The pump device 43 is attached to a mouth portion 41*b* formed in the other-end section of the container body 41, and includes a pump body 45 and a nozzle portion 44.

Further, the duplex discharge container 1 of the fourth embodiment includes a holder 5 for holding the two pump-equipped containers 40, 40 in a juxtaposed state, and a lever 6 (which is also referred to hereinafter simply as "pumping means", or as a "nozzle-integrated lever", a "push button", or a "nozzle-integrated push head") which serves as pumping means configured to perform pumping action of the pump device(s) 43.

First, the pump-equipped container 40 is described. As described above, the container body 41 is a tubular body that is made of a sheet material having flexibility and whose one-end section (also referred to as "lower-end section") 41*a* on the opposite side from the mouth portion (the other-end section) 41*b* is closed off. The container body 41 is formed into a cylindrical shape having, for example, an inner diameter of around 10 to 50 mm and a height (length) of around 70 to 200 mm.

Contents of the two-agent type (not shown), such as hair-dyeing agents or toothpastes, are placed inside the container body 41. The contents employed in the present embodiment are first and second agents of a two-agent-type hair dye. The contents put in the container body 41 are sucked up by the pumping effect of the pump device 43 and discharged from the nozzle portion 44.

In cases where the contents have a property of being deteriorated by oxygen (such as hair-dyeing agents), it is preferable that the container body 41 is made of a sheet material having an oxygen barrier property in order to prevent deterioration of the contents. An example of such a sheet material includes an aluminum-laminated resin.

For example, the lower-end section 41*a* of the container body 41 is closed off as follows. First, the pump device 43 is fixed to the mouth portion 41*b*. Contents are filled into and placed inside the container body 41 from the lower-end section 41*a* according to ordinary methods for forming a pump-equipped tube container. Then, the lower-end section 41*a* is squashed into a flat state, and in doing so, the innermost sealant layer of the aluminum-laminated resin sheet is heat-sealed using known heat-sealing means.

The pump device 43 fixed to the mouth portion 41*b* of the container body 41 is generally made of a synthetic resin such as a polyolefin resin, and is constituted of the pump body 45 and the nozzle portion 44.

The pump body 45 has, in its interior, a known pump mechanism including a measuring chamber 49. Further, the pump body 45 has an outer-circumferential-surface section 46 that comes into close contact with an inner circumferential surface 41*c* of the mouth portion 41*b* of the container body 41, and is fixed to the mouth portion 41*b* in such a state that the outer-circumferential-surface section 46 is covered with the container body 41 by being brought into close contact with the inner circumferential surface 41*c*.

The outer envelope of the pump body 45 is structured by the outer-circumferential-surface section 46 which has a cylindrical sleeve-like shape. The outer diameter of the outer-circumferential-surface section 46 is equal to or slightly larger than the inner diameter of the container body 41. Accordingly, the outer circumferential surface of the outer-circumferential-surface section 46 comes firmly into close contact with the inner circumferential surface 41*c* of the mouth portion 41*b* when the pump body 45 is inserted into and attached to the mouth portion 41*b* of the container body 41.

The outer circumferential surface of the outer-circumferential-surface section 46 of the pump body 45 is made, for example, of a polyolefin resin having heat-sealability. After attachment of the pump body 45 to the mouth portion 41*b* of the container body 41, applying heat-sealing from outside the container body 41 using a known heat-sealing means will allow the outer circumferential surface of the outer-circumferential-surface section 46 of the pump body 45 and the inner circumferential surface 41*c* of the mouth portion 41*b* of the container body 41 to be firmly joined in close contact with one another in a gas-tight state.

As illustrated in FIG. 10, the pump body 45 includes, for example, a cylinder 50, a piston 51, a suction valve 52, a discharge valve 53, a stem 56, a stem retainer 57, a spring 58, and a spring retainer 59. The cylinder 50 has a cylindrical shape and has a suction valve 52 at its lower end. The piston 51 is in close contact with and slides along the inner surface of the cylinder 50, and has a discharge valve 53 at its lower end. A measuring chamber 49 is formed by the closed space defined by the inner surface and the suction valve 52 of the cylinder 50 and the discharge valve 53 of the piston 51.

The stem 56 is a tubular component connected to the upper portion of the piston 51. The stem retainer 57 presses a flanged portion of the stem 56 from above to inhibit the stem 56 from moving upward. The spring retainer 59 is a tubular component connected to the upper portion of the stem 56.

The spring 58 is interposed between the stem retainer 57 and the spring retainer 59. Accordingly, the elastic force of the spring 58 constantly urges the spring retainer 59 away from the stem retainer 57. However, the spring retainer 59 will not disengage from the stem 56 because the nozzle portion 44 connected to the upper portion of the spring retainer 59 is restrained from moving upward by a pressing portion 94 of the lever 6 serving as the pumping means, as will be described below.

As illustrated in FIGS. 8 and 9, the nozzle portion 44 is provided projecting upward from the pump body 45, and is connected to the piston 51 via the spring retainer 59 and the stem 56 which are connected to the lower portion of the nozzle portion 44 (see FIG. 10). The flow path of the nozzle portion 44 is shaped like a crank (a shape that is bent once substantially at right angles and then is bent substantially at right angles in the opposite direction).

With the pump device 43 structured as above, repeatedly pressing the nozzle portion 44 (in the present embodiment, this pressing operation of the nozzle portion 44 is achieved by operating the lever 6 serving as the pumping means, as described further below) will cause the piston 51 to slide in close contact along the cylinder 50, and the pumping effect caused thereby will allow the contents to be sucked from the container body 41 into the measuring chamber 49 through the suction valve 52. Then, a necessary amount of the contents sucked into the measuring chamber 49 can be discharged from a discharge opening 44*a* of the nozzle portion 44 through the discharge valve 53, the stem 56, the spring retainer 59, etc.

In the duplex discharge container 1 of the present fourth embodiment, the pump device 43 having the above-described structure is provided to each of the two juxtaposed pump-equipped containers 40, 40, and the respective, crank-shaped nozzle portions 44, 44 of the two juxtaposed pump-equipped containers 40, 40 are integrated near their discharge openings 44*a*, 44*a*, thus locating the discharge openings 44*a*, 44*a* adjacent to one another. Accordingly, the first and second agents filled respectively inside the two juxtaposed pump-equipped containers 40, 40 will be discharged from adjacent discharge openings 44*a*, 44*a*, and therefore, the first and second agents will be discharged substantially at the same location. The respective flow paths 44*b* of the two nozzle portions 44 have substantially the same cross-sectional area and length.

As described above, the pump device 43 is made of a synthetic resin such as a polyolefin resin, and the pump device 43 formed of such a material does not have an oxygen barrier property per se. Therefore, in the pump device 43 of the present embodiment, an inert gas that is inert to the contents of the container body 41 is filled inside the measuring chamber 49. The term "inert" is used herein in a relative sense with respect to the contents. Specifically, nitrogen gas or helium gas may be given as examples of an inert gas that is inert to contents that are deteriorated by oxygen, such as the hair-dyeing agent in the present embodiment.

Next, the holder 5 is described. The holder 5 is a component for holding the two pump-equipped containers 40, 40 in a juxtaposed state. The holder 5 has two juxtaposed holding portions 81, 81 capable of holding the respective pump-equipped containers 40. Each holding portion 81 of the present embodiment is capable of holding the mouth portion 41*b* of the container body 41 either directly or indirectly via another component.

The holder 5 is structured so that the pump-equipped container 40 is attachable to and detachable from the holding portion 81. There is no limitation to the structure for making the pump-equipped container 40 attachable/detachable, and examples thereof may include fitting-attachment achieved by fitting a projection into a depression, or screwing achieved by screwing together a male screw and a female screw. Fitting-attachment is employed in the present fourth embodiment.

The outer surface of the holder 5 forms a covering portion 82 that covers the mouth portion 41*b* of the container body 41 of each pump-equipped container 40 held by each holding portion 81. Preferably, the covering portion 82 is configured so that the pump body 45 is located within the covering portion 82. In the present embodiment, one of the pump-equipped containers 40 (the pump-equipped container 40 on the right-hand side in FIG. 9) has its pump body 45 located within the covering portion 82, but the other pump-equipped container 40 (the pump-equipped container 40 on the left-hand side in FIG. 9) has its pump body 45 located not only within the covering portion 82 but also outside the covering portion 82.

Next, the pumping means is described. The pumping means is for performing pumping action of the pump device 43. In the present invention, the term "pumping action" refers to an action of causing a pumping effect of the pump device 43, and is achieved through manual operation by a user. The fourth embodiment has a lever 6 as the pumping means, and is so structured that pressing of the lever 6 allows the pumping actions of both pump devices 43, 43 of the two juxtaposed pump-equipped containers 40, 40 to be performed with a single operation. Further, the lever 6 is movably mounted to the holder 5.

In the fourth embodiment, as illustrated in FIG. 9, the lever 6, which serves as the pumping means, has a shape that is bent substantially at right angles, and its base end portion 6A is pivotally supported by one end at the upper portion of the holder 5, taking a rotation shaft 91 as a fulcrum of rotation. An intermediate portion 6B extends sideways from the base end portion 6A of the lever 6, and a through hole 92 is provided in the upper portion of the intermediate portion 6B. Providing the through hole 92 in the intermediate portion 6B allows the section in the vicinity of the discharge openings 44*a*, 44*a* where the two nozzle portions 44, 44 have integrated to pass through the intermediate portion 6B of the lever 6 and project from the upper portion of the intermediate portion 6B.

The intermediate portion 6B of the lever 6 has a pressing portion 94 that is provided surrounding the through hole 92 and that projects toward the nozzle portions 44. The pressing portion 94 abuts against a laterally-extending intermediate portion 44*c* of the nozzle portions 44.

A grip 6C of the lever 6 has an easy-to-grip shape, and is bent downward from the intermediate portion 6B substantially at right angles thereto. Accordingly, holding the grip 6C of the lever 6 and operating the lever 6 taking the rotation shaft 91 as the fulcrum of rotation will cause the pressing portion 94 to press both the nozzle portions 44 of the two juxtaposed pump-equipped containers 40 downward (i.e., toward the measuring chamber 49).

Since the duplex discharge container 1 of the fourth embodiment has the above-described structure, operation of the lever 6 serving as the pumping means will move the piston 51, via the nozzle portions 44 etc., up and down inside the cylinder 50, thus causing the pumping action of the pump devices 43.

The duplex discharge container 1 of the fourth embodiment structured as above achieves the following effects:

The pump body 45 has an outer-circumferential-surface section 46 that comes into close contact with an inner circumferential surface 41*c* of the mouth portion 41*b* of the container body 41, and is fixed to the mouth portion 41*b* of the container body 41 in such a state that the outer-circumferential-surface section 46 is covered with the container body 41 by being brought into close contact with the inner circumferential surface 41*c* of the mouth portion 41*b* of the container body 41. This reduces the number of container components, compared to the duplex discharge container disclosed for example in JP-A-2002-2757. Thus, the cost of components can be reduced, and the time and effort for assembling the components can also be saved.

Further, it is possible to make substantially only the nozzle portion 44 of the pump device 43 project from the mouth portion 41*b* of the container body 41. Thus, it is possible to render the entire duplex discharge container 1 compact.

Next, other embodiments of the duplex discharge container according to the present invention are described. The following mainly describes features of the other embodiments that are different from the foregoing fourth embodiment, and features in common are accompanied with the same symbols and are omitted from explanation. The explanation given in the fourth embodiment applies as appropriate to features that are not particularly explained below. The other embodiments also achieve the same effects as those of the fourth embodiment.

Figure 11:
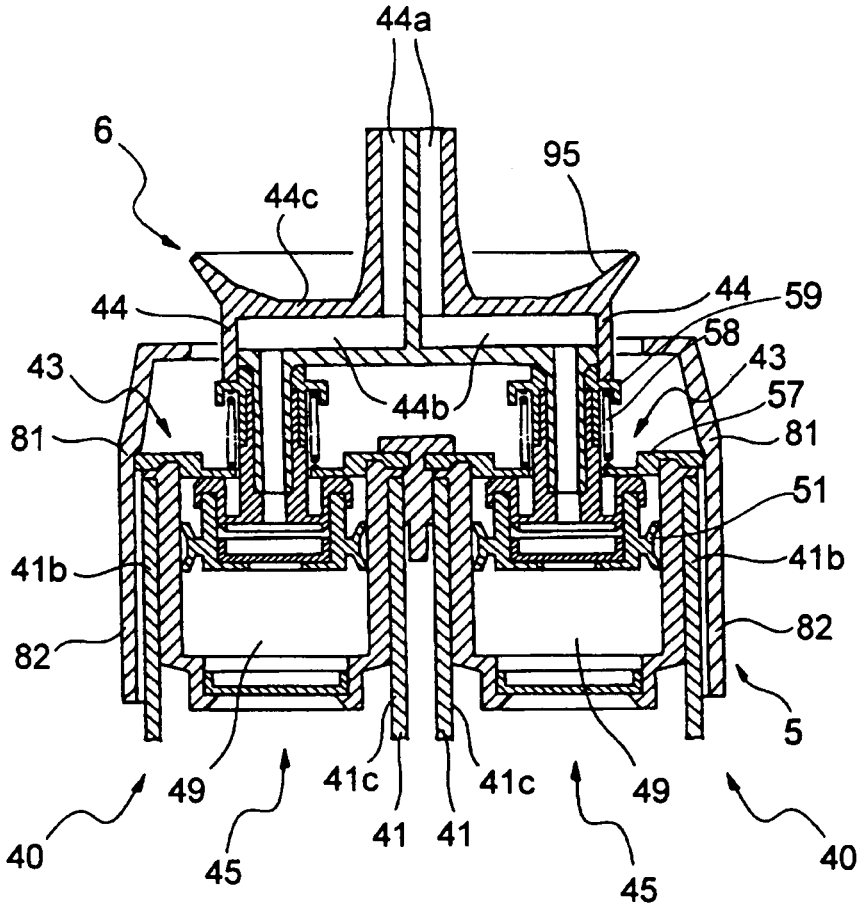
FIG. 11 is a partially-enlarged cross-sectional view (a view corresponding to FIG. 9) of an upper portion of a duplex discharge container according to a fifth embodiment of the present invention.

As illustrated in FIG. 11, in a duplex discharge container 1 according to a fifth embodiment, the pumping means is made up of a nozzle-integrated lever 6. The nozzle-integrated lever 6 is formed on and into a single unit with the upper portion of a laterally-extending intermediate portion 44*c* of the integrated crank-shaped nozzle portions 44. The nozzle-integrated lever 6 is shaped like a bowl, with its peripheral edge 95 rising up, and is configured so that the pumping action of the two pump devices 43 can be performed with a single operation by simultaneously pressing the integrated nozzle portions 44 with the user's finger.

In addition to achieving the same effects as those of the fourth embodiment, the duplex discharge container 1 of the fifth embodiment allows further reduction in the width of the entire container because the nozzle-integrated lever 6, which serves as the pumping means, does not project sideways from the holder 5.

Figure 12:
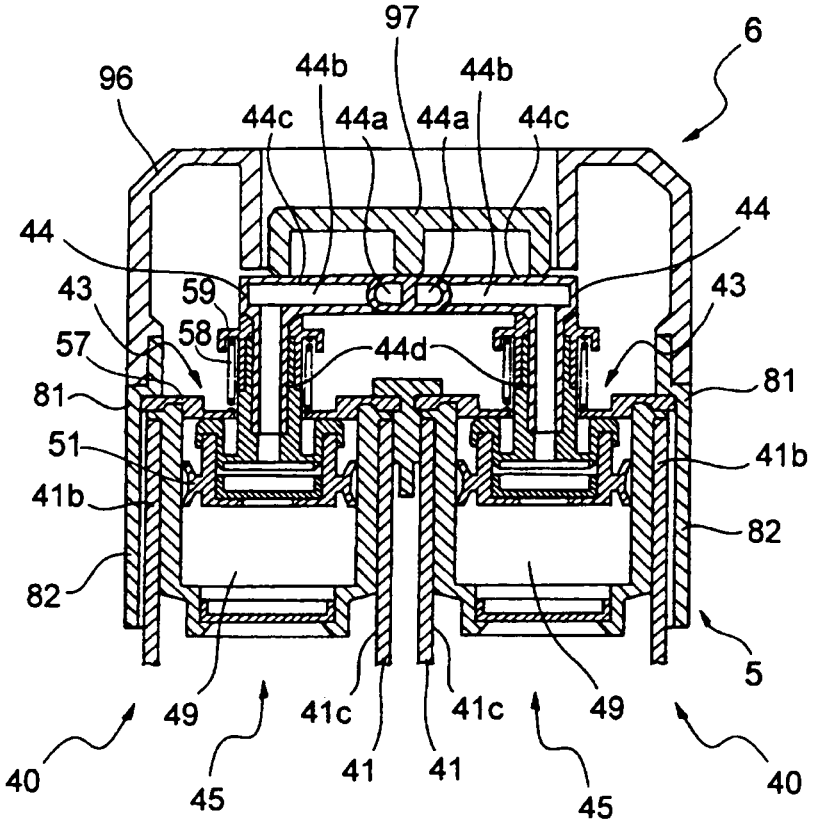
FIG. 12 is a partially-enlarged cross-sectional view (a view corresponding to FIG. 9) of an upper portion of a duplex discharge container according to a sixth embodiment of the present invention.

As illustrated in FIG. 12, a duplex discharge container 1 according to a sixth embodiment differs from the fourth embodiment in that the bent shape of the nozzle portions 44, 44 is not two-dimensional, but is instead three-dimensional. Further, the structure of the pumping means is also different.

More specifically, the nozzle portions 44 of the sixth embodiment are similar to the nozzle portions 44 of the fourth embodiment in that their base end portions 44*d* extend upward from their respective pump bodies 45, the nozzle portions 44 are bent to form laterally-extending intermediate portions 44*c*, and the nozzle portions 44, 44 of the two juxtaposed pump-equipped containers 40, 40 integrate.

However, the discharge opening 44*a* of the nozzle portion 44 extends in a direction orthogonal to a virtual plane that contains the direction in which the base end portion 44*d* extends and the direction in which the intermediate portion 44*c* extends. In other words, the discharge direction in the fourth and fifth embodiments is in the length direction of the container body 41 of the pump-equipped container 40, whereas the discharge direction in the sixth embodiment is in a direction orthogonal to a virtual plane that contains the length direction of the container body 41 of the pump-equipped container 40 and the direction in which the two juxtaposed pump-equipped containers 40, 40 are lined up.

Further, in the sixth embodiment, the pumping means is made up of a push button 6. This is described in detail. A closure 96 covering the integrated nozzle portions 44, 44 is provided on the upper portion of the holder 5. A button member 97 that can slide up and down with respect to the closure 96 is provided in the upper central portion of the closure 96. The button member 97 is constantly urged upward by an elastic member (not shown), but it can be pressed downward to press the intermediate portions 44*c* of the nozzle portions 44 downward, thus structuring the push button 6.

In addition to achieving the same effects as those of the fourth embodiment, the duplex discharge container 1 of the sixth embodiment allows further reduction in the width of the entire container and also has a good design because the push button 6, which serves as the pumping means, does not project sideways from the holder 5. Furthermore, the pumping means can be operated simply with one finger, thus allowing easy operation.

Figure 13:
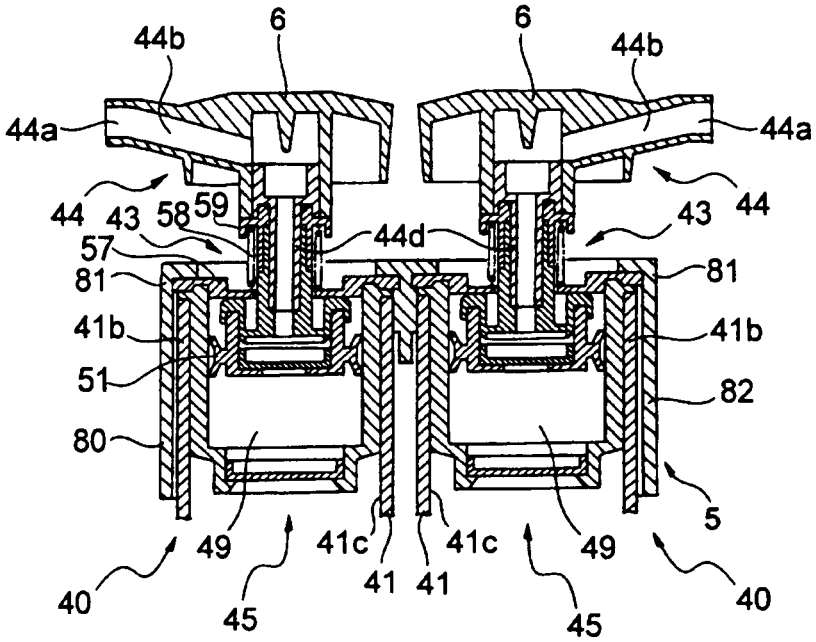
FIG. 13 is a partially-enlarged cross-sectional view (a view corresponding to FIG. 9) of an upper portion of a duplex discharge container according to a seventh embodiment of the present invention.

As illustrated in FIG. 13, a duplex discharge container 1 according to a seventh embodiment differs from the fourth embodiment in the following aspects: (1) the nozzle portion 44 is not shaped like a crank, but has a shape bent only once substantially at right angles; (2) the respective nozzle portions 44, 44 of the two juxtaposed pump-equipped containers 40 are not integrated; and (3) the nozzle-integrated push head 6, which serves as the pumping means, is provided separately for each of the pump devices 43, 43 of the two juxtaposed pump-equipped containers 40, 40, and the pumping action of each pump device 43, 43 can be performed separately.

More specifically, in the nozzle portion 44 of the seventh embodiment, the base end portion 44*d* extends upward from the pump body 45, the nozzle portion 44 are then bent, and the discharge opening 44*a* extends laterally outward. That is, in contrast to the nozzle portions 44 of the fourth and fifth embodiments that are shaped like a crank bent twice substantially at right angles, the nozzle portion 44 of the seventh embodiment is L-shaped, bent once substantially at right angles.

The pumping means is made up of the nozzle-integrated push head 6, and is provided integrally on the upper portion of each nozzle portion 44. Such a nozzle-integrated push head 6 allows the pumping action of the respective pump devices 43 of the two juxtaposed pump-equipped containers 40, 40 to be performed separately.

In addition to achieving the same effects as those of the fourth embodiment, the duplex discharge container 1 of the seventh embodiment can easily make the discharge amount of the first agent different from the discharge amount of the second agent.

Below, another duplex discharge container 1 of the present invention is described according to an eighth embodiment, which is one preferred embodiment, with reference to the drawings.

Figure 14:
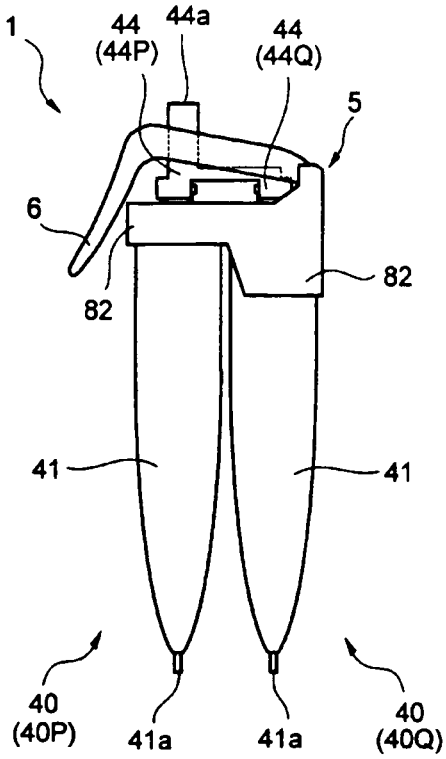
FIG. 14 is a front view showing a duplex discharge container according to an eighth embodiment of the present invention.
Figure 15:
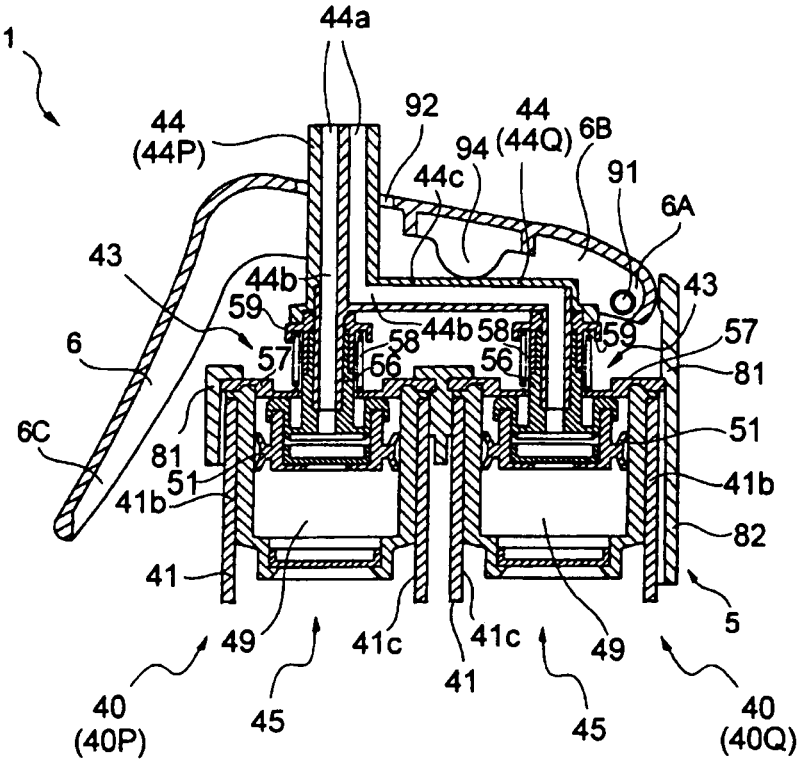
FIG. 15 is a partially-enlarged cross-sectional view of an upper portion of the duplex discharge container of the eighth embodiment.

As illustrated in FIGS. 14 and 15, the duplex discharge container 1 according to the eighth embodiment is a duplex discharge container having two juxtaposed first and second pump-equipped containers 40, 40 each having a container body 41 and a pump device 43, like the fourth embodiment.

Further, as with the duplex discharge container 1 of the fourth embodiment, the duplex discharge container 1 of the eighth embodiment includes a holder 5 for holding the two pump-equipped containers 40, 40 in a juxtaposed state, and pumping means (a lever) 6 configured to perform pumping action of the pump device 43.

The container bodies 41 of the respective pump-equipped containers 40, 40 contain contents of the two-agent type (not shown), such as hair-dyeing agents, adhesives, or toothpastes. The contents of the first pump-equipped container 40 (40P) have a property that requires them to be discharged from the nozzle portion 44 before the contents of the second pump-equipped container 40 (40Q). In the present eighth embodiment, the contents of the first pump-equipped container 40P and the contents of the second pump-equipped container 40Q are, respectively, first and second agents of a two-agent-type hair dye. From the above reason, the first agent needs to be discharged from the nozzle portion 44 before the second agent. The contents put in the container body 41 are sucked up by the pumping effect of the pump device 43 and discharged from the nozzle portion 44.

As illustrated in FIG. 15, in the duplex discharge container 1 of the present eighth embodiment, the nozzle portion 44 is provided projecting upward from the pump body 45, and is connected to the piston 51 via the spring retainer 59 and the stem 56 which are connected to the lower portion of the nozzle portion 44. The flow path 44*b* of the nozzle portion 44 of the first pump-equipped container 40P is linear, while the flow path 44*b* of the nozzle portion 44 of the second pump-equipped container 40Q is shaped like a crank.

In the duplex discharge container 1 of the present eighth embodiment, the pump device 43 having the above-described structure, which is similar to that of the duplex discharge container 1 of the fourth embodiment, is provided to each of the two juxtaposed pump-equipped containers 40, 40, and the respective nozzle portions 44, 44 of the two juxtaposed pump-equipped containers 40, 40 are integrated near their discharge openings 44*a*, 44*a*, thus locating the discharge openings 44*a*, 44*a* adjacent to one another. Accordingly, the first and second agents filled respectively inside the two juxtaposed pump-equipped containers 40, 40 will be discharged from adjacent discharge openings 44*a*, 44*a*, and therefore, the first and second agents will be discharged substantially at the same location. The respective flow paths 44*b*, 44*b* of the two nozzle portions 44, 44 have substantially the same cross-sectional area.

Next, the holder 5 is described. The holder 5 is structured similarly to the one used for the duplex discharge container 1 of the fourth embodiment. The holder 5 is a component for holding the two pump-equipped containers 40, 40 in a juxtaposed state. The holder 5 has two juxtaposed holding portions 81, 81 capable of holding the respective pump-equipped containers 40. Each holding portion 81 of the present embodiment is capable of holding the mouth portion 41*b* of the container body 41 either directly or indirectly via another component.

Next, the pumping means 6 is described. The pumping means 6 has substantially the same structure as the one used for the duplex discharge container 1 of the fourth embodiment. The pumping means 6 is for performing pumping action of the pump devices 43. The eighth embodiment is so structured that the pumping actions of both pump devices 43, 43 of the two juxtaposed pump-equipped containers 40, 40 can be performed with a single operation. Further, the pumping means 6 is movably mounted to the holder 5.

In the eighth embodiment, as illustrated in FIG. 15, the pumping means 6 has the shape of a lever that is bent substantially at right angles, and its base end portion 6A is pivotally supported by one end at the upper portion of the holder 5, taking a rotation shaft 91 as a fulcrum of rotation. An intermediate portion 6B extends sideways from the base end portion 6A of the pumping means 6, and a through hole 92 is provided in the upper portion of the intermediate portion 6B. Providing the through hole 92 in the intermediate portion 6B allows the section in the vicinity of the discharge openings 44*a* where the two nozzle portions 44 have integrated to pass through the intermediate portion 6B of the pumping means 6 and project from the upper portion of the intermediate portion 6B.

The intermediate portion 6B of the pumping means 6 has a pressing portion 94 projecting toward the nozzle portions 44. The pressing portion 94 abuts against a laterally-extending intermediate portion 44*c* of the nozzle portion 44 of the second pump-equipped container 40Q. The pressing portion 94 inhibits the nozzle portions 44, which are urged toward the pumping means 6 due to the elastic force of their respective springs 58, from moving upward, and the nozzle portions 44 are so designed that they do not move upward beyond that position.

A grip 6C of the pumping means 6 has an easy-to-grip shape, and is bent downward from the intermediate portion 6B substantially at right angles thereto. Accordingly, holding the grip 6C of the pumping means 6 and operating the pumping means 6 taking the rotation shaft 91 as the fulcrum of rotation will cause the pressing portion 94 to press both the nozzle portions 44, 44 of the two juxtaposed pump-equipped containers 40, 40 downward (i.e., toward the measuring chamber 49).

In the present eighth embodiment, the flow path 44*b* of the nozzle portion 44 of the first pump-equipped container 40P and the flow path 44*b* of the nozzle portion 44 of the second pump-equipped container 40Q are structured asymmetrically such that, when the pumping means 6 is used to perform the pumping action of the respective pump devices 43, 43 of the juxtaposed first and second pump-equipped containers 40P and 40Q, the contents of the first pump-equipped container 40P are discharged from the nozzle portion 44 before the contents of the second pump-equipped container 40Q.

More specifically, in the eighth embodiment, the length L1 of the flow path 44*b* of the nozzle portion 44 of the first pump-equipped container 40P is shorter than the length L2 of the flow path 44*b* of the nozzle portion 44 of the second pump-equipped container 40Q. The difference, the ratio, etc. between the lengths L1 and L2 may be set as appropriate depending, for example, on the viscosity of the first and second agents, the viscous friction between the contents and the flow path 44*b* of the nozzle portion 44, and/or the cross-sectional area and bent shape of the flow path 44*b* of the nozzle portion 44. For example, the difference between the lengths L1 and L2 is 2 to 10 cm, and the ratio (L1/L2) between the lengths L1 and L2 is 0.3 to 0.6.

Further, since the respective flow paths 44*b*, 44*b* of the two nozzle portions 44, 44 of the two juxtaposed pump-equipped containers 40P and 40Q have substantially the same cross-sectional area, the volume V1 of the flow path 44*b* of the nozzle portion 44 of the first pump-equipped container 40P is smaller than the volume V2 of the flow path 44*b* of the nozzle portion 44 of the second pump-equipped container 40Q.

The difference, the ratio, etc. between the volumes V1 and V2 may be set as appropriate depending, for example, on the viscosity of the first and second agents, the viscous friction between the contents and the flow path 44*b* of the nozzle portion 44, and/or the length, cross-sectional area, and bent shape of the flow path 44*b* of the nozzle portion 44. For example, the difference between the volumes V1 and V2 is 2 to 10 $cm^3$, and the ratio (V1/V2) between the volumes V1 and V2 is 0.3 to 0.6.

Since the duplex discharge container 1 of the eighth embodiment has the above-described structure, operation of the pumping means 6 will move the piston 51, via the nozzle portions 44 etc., up and down inside the cylinder 50, thus causing the pumping action of the pump devices 43.

The duplex discharge container 1 of the eighth embodiment structured as above achieves the following effects:

In the duplex discharge container 1 of the eighth embodiment, the length L1 of the flow path 44*b* of the nozzle portion 44 of the first pump-equipped container 40P is shorter than the length L2 of the flow path 44*b* of the nozzle portion 44 of the second pump-equipped container 40Q, and the volume V1 of the flow path 44*b* of the nozzle portion 44 of the first pump-equipped container 40P is smaller than the volume V2 of the flow path 44*b* of the nozzle portion 44 of the second pump-equipped container 40Q.

Accordingly, the duplex discharge container 1 of the eighth embodiment allows the contents of the first pump-equipped container 40P to be discharged from the nozzle portion 44 before the contents of the second pump-equipped container 40Q when the pumping means 6 is used to perform the pumping action of the respective pump devices 43, 43 of the juxtaposed first and second pump-equipped containers 40P and 40Q.

Further, the pump body 45 has an outer-circumferential-surface section 46 that comes into close contact with the inner circumferential surface 41*c* of the mouth portion 41*b* of the container body 41, and is fixed to the mouth portion 41*b* of the container body 41 in such a state that the outer-circumferential-surface section 46 is covered with the container body 41 by being brought into close contact with the inner circumferential surface 41*c* of the mouth portion 41*b* of the container body 41. This allows substantially only the nozzle portion 44 of the pump device 43 to project from the mouth portion 41*b* of the container body 41. Thus, it is possible to render the entire duplex discharge container 1 compact.

Next, another embodiment of the duplex discharge container 1 according to the present invention is described. The following mainly describes features of the other embodiment that are different from the foregoing eighth embodiment, and features in common are accompanied with the same symbols and are omitted from explanation. The explanation given in the eighth embodiment applies as appropriate to features that are not particularly explained below. The other embodiment also achieves the same effects as those of the eighth embodiment.

In this other, ninth embodiment, the volume V1 of the flow path 44*b* of the nozzle portion 44 of the first pump-equipped container 40P is smaller than the volume V2 of the flow path 44*b* of the nozzle portion 44 of the second pump-equipped container 40Q, as in the eighth embodiment. However, the means for achieving the above is different.

Figure 16:
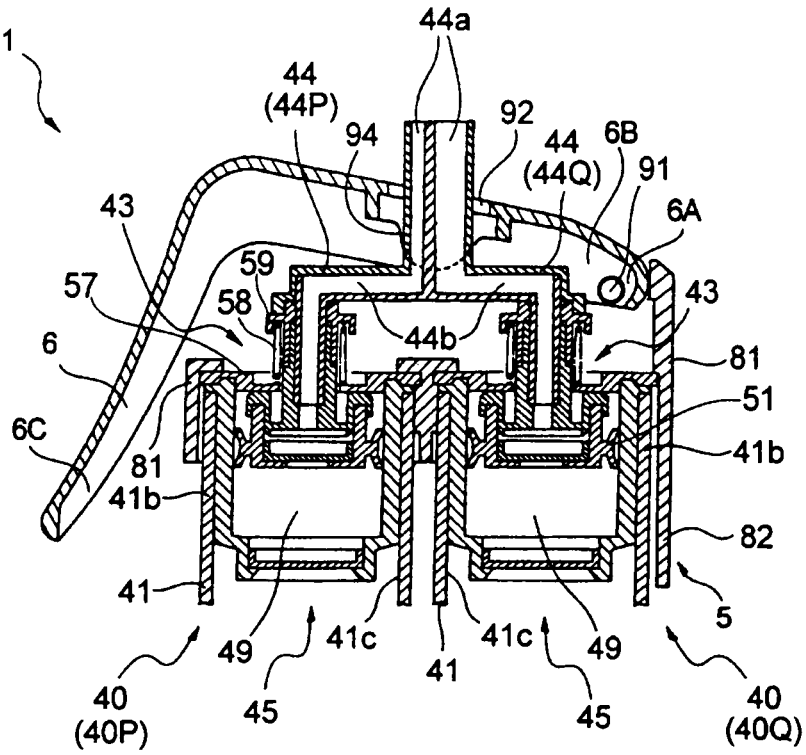
FIG. 16 is a partially-enlarged cross-sectional view (a view corresponding to FIG. 15) of an upper portion of a duplex discharge container according to a ninth embodiment of the present invention.

More specifically, both the flow path 44*b* of the nozzle portion 44 of the first pump-equipped container 40P and the flow path 44*b* of the nozzle portion 44 of the second pump-equipped container 40Q are shaped like a crank and have substantially the same length. However, as illustrated in FIG. 16, although the flow path 44*b* of the nozzle portion 44 of the first pump-equipped container 40P has a constant cross-sectional area, the cross-sectional area of the nozzle portion 44 of the second pump-equipped container 40Q in the vicinity of the discharge opening 44*a* is made larger than the cross-sectional areas of the other portions (which are equal to the cross-sectional area of the flow path 44*b* of the nozzle portion 44 of the first pump-equipped container 40P). In this way, the volume V1 of the flow path 44*b* of the nozzle portion 44 of the first pump-equipped container 40P is made smaller than the volume V2 of the flow path 44*b* of the nozzle portion 44 of the second pump-equipped container 40Q.

In the ninth embodiment, the length L1 of the flow path 44*b* of the nozzle portion 44 of the first pump-equipped container 40P and the length L2 of the flow path 44*b* of the nozzle portion 44 of the second pump-equipped container 10Q are substantially the same.

Note that there is no limitation to the structure for making the cross-sectional areas of the flow paths 44*b* of the nozzle portions 44 different. For example, the cross-sectional area of the flow path 44*b* of the nozzle portion 44 of the first pump-equipped container 40P may be made smaller along the entire flow path 44*b* thereof, than the cross-sectional area of the flow path 44*b* of the nozzle portion 44 of the second pump-equipped container 40Q.

The volumes of the flow paths 44*b* may be made different by rendering the lengths of the flow paths 44*b* different in addition to rendering the cross-sectional areas of the flow paths 44*b* of the nozzle portions 44 different.

In addition to achieving the same effects as those of the eighth embodiment, the duplex discharge container 1 of the ninth embodiment also allows highly-viscous contents to be discharged with a slight push by increasing the cross-sectional area of the flow path 44*b* of the nozzle portion 44.

The duplex discharge container of the present invention is not limited to the foregoing embodiments and may be modified in various ways. For example, the structures in the various embodiments described above may be combined as appropriate.

Other than heat-sealing, hot-melt adhesives may be employed as means for joining the outer-circumferential-surface section 46 of the pump body 45 and the inner circumferential surface 41*c* of the mouth portion 41*b* of the container body 41 into close contact with one another.

Further, the shape into which the flow paths 44*b* of the nozzle portions 44 are bent is not limited to the bent shape of the flow paths 44*b* of the nozzle portions 44 described in the foregoing embodiments.

The pumping means 6 is not limited to a lever structure as in the foregoing embodiments, but may be integrated with the nozzle portion(s) 44 or may be structured as a push button.

INDUSTRIAL APPLICABILITY

The pump-equipped container of the present invention allows the entire container to be downsized easily. Further, forming the container body using a sheet material having an oxygen barrier property not only allows downsizing of the entire container, but also allows deterioration of contents prior to use, such as during distribution, to be avoided effectively even when contents prone to deteriorate through oxidization are contained.

Furthermore, filling an inert gas that is inert to the contents of the container body inside the measuring chamber of the pump body allows a gas barrier property to be achieved, at low cost, in the pump device as well as the entire pump-equipped container without forming the pump device using components having a gas barrier property.

Moreover, according to the duplex discharge container of the present invention having two pump-equipped containers juxtaposed to one another, the number of components of the container can be reduced, and thus, the cost of components can be reduced and the time and effort for assembling the components can also be saved.

Further, in the duplex discharge container that includes two juxtaposed pump-equipped containers each having a pump device including a pump body and a nozzle portion, configuring the container in such a manner that the contents in one of the pump-equipped containers are discharged from the nozzle portion before the contents of the other pump-equipped container will allow the contents in the one pump-equipped container to be discharged at an appropriate timing with respect to the contents of the other pump-equipped container.

The invention claimed is:

1. A pump-equipped container comprising:

a container body that is tubular, includes a flexible sheet material having a gas barrier property, and contains contents; and a pump device that comprises a pump body including a measuring chamber and a nozzle portion, the pump body device made of synthetic resin that does not have the gas barrier property, wherein a one-end section of the container body is closed off, the pump device is attached to an other-end section of the container body that forms a mouth portion of the container body, such that the pump device is inserted into the mouth portion, and only the nozzle portion substantially projects from the mouth portion, and the measuring chamber is filled with an inert gas that is inert to the contents of the container body.

2. The pump-equipped container according to claim 1, wherein a discharge valve of a pump mechanism provided inside the pump body is a mechanical valve that does not open by pressurization of the inert gas inside the measuring chamber, but opens mechanically by depressing the nozzle portion.

3. A duplex discharge container including first and second pump-equipped containers according to the pump-equipped container of claim 1 juxtaposed to one another, the duplex discharge container comprising:

a holder for holding the two pump-equipped containers in a juxtaposed state; and a pump configured to perform pumping action of the pump device.

4. The duplex discharge container according to claim 3, wherein:

the nozzle portion of each of the juxtaposed pump-equipped containers is arranged such that a discharge opening of each nozzle portion is adjacent to one another;

the pump is configured to perform pumping action of the pump device of both of the juxtaposed pump-equipped containers with a single operation; and the duplex discharge container is configured such that, when contents are placed inside the container body of each of the pump-equipped containers and the pump performs the pumping action, the contents in the first pump-equipped container are discharged from the nozzle portion before the contents of the second pump-equipped container.

5. A duplex discharge container including first and second pump-equipped containers according to the pump-equipped container of claim 2 juxtaposed to one another, the duplex discharge container comprising:

a holder for holding the two pump-equipped containers in a juxtaposed state; and a pump configured to perform pumping action of the pump device.

6. The duplex discharge container according to claim 4, wherein the flexible sheet material has heat-sealability, such that an inner circumferential surface of the container body is heat-sealed to an outer-circumferential-surface section of the pump body that is covered by the container body.

7. The duplex discharge container according to claim 6, wherein the flexible sheet material is a polyolefin resin.

8. The duplex discharge container according to claim 4, wherein a flow path of the first pump-equipped container has a volume that is smaller than a flow path of the second pump-equipper container so that the contents in the one of the first pump-equipped container are discharged from the nozzle portion before the contents of the second pump-equipped container.

9. The duplex discharge container according to claim 8, wherein the flow path of the second pump-equipped container has a cross-sectional area that is larger than a cross-sectional area of the flow path of the first pump-equipped container.

10. The duplex discharge container according to claim 9, wherein the flow path of the first pump-equipped container is linear, and the flow path of the second pump-equipped container has a crank shape.

11. The duplex discharge container according to claim 8, wherein the flow path of the first pump-equipped container is linear, and the flow path of the second pump-equipped container has a crank shape.

12. The pump-equipped container according to claim 2, wherein the mechanical valve includes a valve head connected to a sliding tube, the sliding tube including a hollow interior and an opening, through which contents can travel from the measuring chamber to the nozzle portion when the nozzle portion is depressed.

13. The pump-equipped container according to claim 1, wherein the pump device contacts the mouth portion of the container body so that an outer circumferential surface section of the pump body is covered with the container body by close contact with the inner circumferential surface of the mouth portion of the container body.

14. The pump-equipped container according to claim 13, wherein the flexible sheet material has heat-sealability, such that the inner circumferential surface of the mouth portion is heat-sealed to the outer-circumferential-surface section of the pump body that is covered by the mouth portion.

15. The pump-equipped container according to claim 13, wherein the outer circumferential surface of the pump body and the inner circumferential surface of the mouth portion are fixed together by fitting and attaching the surfaces together with screws or a drive-fitting.

16. The pump-equipped container according to claim 1, wherein the gas barrier property is an oxygen barrier property, and the contents are deteriorated by oxygen.

17. The pump-equipped container according to claim 1, wherein the contents are one or more hair-dyeing agents.

18. The pump-equipped container according to claim 1, further comprising:

a barrier member having the gas barrier property that substantially covers the mouth portion, and through which the nozzle portion projects.

19. The pump-equipped container according to claim 1, wherein the container body covers an outer wall of the pump device that forms an exterior of the measuring chamber, such that the inert gas in the measuring chamber fills a majority of space between the contents and the mouth portion.

20. The pump-equipped container according to claim 19, wherein the inert gas in the measuring chamber fills substantially all of the space between the contents and the mouth portion, except for the outer wall of the pump device that forms the exterior of the measuring chamber.

* * * * *